US008307568B2

(12) United States Patent
Bell

(10) Patent No.: US 8,307,568 B2
(45) Date of Patent: Nov. 13, 2012

(54) MULTILAYER PROTECTIVE BOOT

(75) Inventor: Douglas W. Bell, North Vancouver (CA)

(73) Assignee: Alliance Mercantile Inc., Burnaby (CA)

( * ) Notice: Subject to any disclaimer, the term of this patent is extended or adjusted under 35 U.S.C. 154(b) by 1086 days.

(21) Appl. No.: 12/035,986

(22) Filed: Feb. 22, 2008

(65) Prior Publication Data

US 2008/0201987 A1 Aug. 28, 2008

Related U.S. Application Data

(60) Provisional application No. 60/891,448, filed on Feb. 23, 2007.

(51) Int. Cl.
*A43B 1/10* (2006.01)
*A43C 13/14* (2006.01)

(52) U.S. Cl. ..... 36/4; 36/72 R; 36/77 R; 36/77 M; 36/73

(58) Field of Classification Search ..... 36/4, 72 R, 36/77 R, 73, 77 M
See application file for complete search history.

(56) References Cited

U.S. PATENT DOCUMENTS

| | | | | |
|---|---|---|---|---|
| 3,308,560 | A * | 3/1967 | Jones | 36/4 |
| 3,742,623 | A * | 7/1973 | Groothaert | 36/4 |
| 4,845,862 | A * | 7/1989 | Phillips et al. | 36/83 |
| 4,870,762 | A * | 10/1989 | Lee | 36/77 R |
| 5,068,982 | A | 12/1991 | Devasthal | |
| 5,272,822 | A | 12/1993 | Diaz | |
| 5,546,680 | A * | 8/1996 | Barma et al. | 36/108 |
| 5,926,977 | A | 7/1999 | Sanders | |
| 6,427,362 | B2 | 8/2002 | Rork et al. | |
| 6,442,873 | B2 * | 9/2002 | Rork et al. | 36/88 |
| 6,631,569 | B1 * | 10/2003 | Scharbius et al. | 36/72 R |
| 6,832,442 | B2 | 12/2004 | Lewis et al. | |
| 2006/0059718 | A1 | 3/2006 | Dion | |
| 2008/0115387 | A1 * | 5/2008 | Walworth et al. | 36/132 |

FOREIGN PATENT DOCUMENTS

| | | |
|---|---|---|
| GB | 2397742 A | 8/2004 |
| WO | WO-92/14372 | 9/1992 |

* cited by examiner

*Primary Examiner* — Ted Kavanaugh
(74) *Attorney, Agent, or Firm* — Island IP Law; Stephen R. Burri

(57) ABSTRACT

There is provided a multilayer protective boot having means for flame resistance, electric shock resistance and chainsaw cut resistance. The boot is designed to meet all of the NFPA 1971:2007, CE/EN ISO 20345-2:1996, and CSA-Ω standards for firefighter protective footwear and the CE/EN ISO 20345-2 SB E, CSA Class 1/ANSI, CE Chainsaw Class 3, and CSA "Green Tree" Chainsaw Z195-02 standards for chainsaw operator protective footwear These standards are met through the use of layers of Kevlar®, rubber and polyamide tricot materials in the vamp, leg, sole, toe cap and back reinforcement regions of the protective boot.

2 Claims, 4 Drawing Sheets

MULTILAYER PROTECTIVE BOOT

CROSS REFERENCE TO RELATED APPLICATIONS

This non-provisional application claims the benefit of domestic priority from US provisional patent application No. 60/891448 filed Feb. 23, 2007 by Douglas W. Bell.

BACKGROUND OF THE INVENTION

1. Field of the Invention

The present invention relates to protective apparel. In particular, the present invention relates to multilayer protective footwear which helps reduce injury from flame, electric shock, cutting and other hazards commonly faced by emergency response personnel.

2. Description of Related Art

Safety standards for conventional firefighter footwear require that the footwear be flame and electric shock resistant, and prevent puncture of the sole region, as the footwear may be exposed to flames, sharp objects on the ground, and the hazardous combination of water and electricity.

It is known to provide protective footwear which is flame resistant. One example of such footwear includes U.S. Pat. No. 5,068,982 issued Dec. 3, 1991 to Devasthal. It is further known to provide protective footwear which can withstand sole puncture by sharp objects which may be stepped upon. An example of such footwear is U.S. Patent Publication No. US 2006/0059718 A1 published Mar. 23, 2006 and assigned to STC Footwear Inc. The prior art also includes footwear which is flame and shock resistant and can withstand sole puncture.

Safety standards for chainsaw operators, such as conventional tree harvesters, require that the vamp and leg region of the footwear be able to resist full penetration by a chainsaw running at 28 meters per second, with pressure of 30 Newtons, run until the chainsaw stops, and that the steel toe be able to resist impact to 125 joules. Prior art boots exist which meet the safety standards for chainsaw operation.

At present, emergency response personnel, for example, forest firefighters, who are required both to fight fires and to operate a chainsaw, do not have adequate protective footwear available. Ideally, they should have protective footwear which is resistant both to flame and to electric shock, which can resist toe and sole impact, and which can resist full penetration by a chainsaw running at 28 meters per second, with pressure of 30 Newtons, run until the chainsaw stops.

It is known to provide protective devices which could be used in combination with firefighter protective boots to withstand contact by an operating chainsaw blade for a limited period of time. An example of such a device is disclosed in U.S. Pat. No. 5,272,822 issued Dec. 28, 1993 to Diaz. The Diaz patent, however, does not teach a unitary boot which is flame, electric shock and puncture resistant, and which can withstand contact by an operating chainsaw blade.

It is further known to provide clothing, such as pants, which are made of a material which is resistant to flame and to cutting, as in U.K. Patent Publication No. 2,397,742 published Aug. 4, 2004 and assigned to Dolmar GmbH. However, the Dolmar patent does not teach protective footwear.

In view of the foregoing, it would be desirable to have a protective boot which is resistant to flame, electric shock, toe and sole impact, and chainsaw cutting, that is, a protective boot which meets the following firefighter standards:

National Fire Protection Association 1971 2007 edition ("NFPA 1971:2007");

CE/EN ISO 20345-2:1996; and

CSA Omega ("CSA-Ω");

as well as the following chainsaw operator standards:

CE/EN ISO 20345-2 SB E;

CSA Class 1/ANSI;

CE Chainsaw Class 3; and

CSA "Green Tree" Chainsaw Z195-02.

Such protective footwear is not currently available.

BRIEF SUMMARY OF THE INVENTION

There is provided a protective boot having means for flame resistance, electric shock resistance, puncture prevention and chainsaw cut resistance. The protective boot is designed to meet the NFPA 1971:2007, CE/EN ISO 20345-2:1996, and CSA-Ω standards for firefighter protective footwear and the CE/EN ISO 20345-2 SB E, CSA Class 1/ANSI, CE Chainsaw Class 3, and CSA "Green Tree" Chainsaw Z195-02 standards for chainsaw operator protective footwear.

The boot may have an upper having a multilayer leg, a multilayer vamp, a multilayer toe cap and a multilayer back reinforcement; a foxing; and a multilayer sole; wherein the protective boot has means for flame resistance, means for electric shock resistance and means for chainsaw cut resistance.

The means for flame resistance may comprise at least one layer of a rubber blend in each of the upper, the foxing and the sole of a rubber blend. The rubber blend composition in the upper may comprise 58% to 62% by weight natural rubber, 18% to 22% by weight nitrile rubber and 18% to 22% by weight neoprene rubber; and the rubber blend composition in the foxing and sole may comprise 46% to 60% by weight natural rubber, 20% to 27% by weight nitrile rubber and 20% to 27% by weight neoprene rubber.

The means for electric shock resistance may comprise at least one layer in each of the upper, the foxing and the sole of a rubber blend containing a synthetic rubber. The synthetic rubber of the rubber blend may have an electrical resistance which will insulate to at least 18 Kilovolts.

The means for chainsaw cut resistance may comprise at least one layer in each of the vamp and the leg of Kevlar® (TM of E.I. du Pont de Nemours); at least one internal layer in each of the vamp and leg of polyamide tricot, and at least one layer in each of the vamp and the leg of a rubber material. The rubber material may be natural rubber, or a rubber blend which includes a synthetic rubber.

The vamp may further comprise an innermost first vamp layer containing Kevlar®; a second vamp layer containing polyamide tricot engaging the first vamp layer; a third vamp layer of polyamide tricot engaging the second vamp layer; a fourth vamp layer of rubber engaging the third vamp layer; a fifth vamp layer of rubber engaging the fourth vamp layer; a sixth vamp layer of rubber engaging the fifth vamp layer; and an outermost seventh vamp layer of rubber engaging the sixth vamp layer.

The innermost first vamp layer may be 0.54 mm to 0.64 mm, preferably 0.60 mm thick; the polyamide tricot in the second vamp layer may be 0.18 mm to 0.22 mm, preferably 0.20 mm thick; the third vamp layer may be 0.18 mm to 0.22 mm, preferably 0.20 mm thick; the fourth vamp layer may be 1.1 mm to 1.3 mm, preferably 1.2 mm thick; and the fifth vamp layer may be 1.8 mm to 2.2 mm, preferably 2.0 mm thick.

The leg may further comprise an innermost first leg layer containing Kevlar®; a second leg layer of polyamide tricot engaging the first leg layer; a third leg layer of rubber and polyester textile engaging the second leg layer; a fourth leg layer of rubber engaging the third leg layer; a fifth leg layer of rubber engaging the fourth leg layer; a sixth leg layer of polyamide tricot engaging the fifth leg layer; a seventh leg layer of rubber engaging the sixth leg layer; and an outermost eighth leg layer of rubber engaging the seventh leg layer.

The innermost first leg layer may be 0.57 mm to 0.69 mm, preferably 0.63 mm thick; the polyamide tricot in the second leg layer may be 0.18 mm to 0.22 mm, preferably 0.20 mm thick; the third leg layer may be 0.13 mm to 0.17 mm, preferably 0.15 mm thick; the fourth leg layer may be 1.1 mm to 1.3 mm, preferably 1.2 mm thick; the fifth leg layer may be 0.9 mm to 1.1 mm, preferably 1.0 mm thick; the seventh leg layer may be 0.9 mm to 1.1 mm, preferably 1.0 mm thick; and the outermost eighth leg layer may be 1.1 mm to 1.3 mm, preferably 1.2 mm thick.

The sole may further comprise an innermost first sole layer containing rubber; a second sole layer of rubber and steel engaging the first sole layer; a third sole layer of rubber engaging the second sole layer; a fourth sole layer of rubber, engaging the third sole layer; and fifth, sixth, seventh, eighth, and ninth layers of rubber, each engaging the previous sole layer.

The innermost first sole layer may be 2.7 mm to 3.3 mm, preferably 3.0 mm thick; the steel in the second sole layer may be 0.90 mm to 1.1 mm, preferably 1.0 mm thick; the third sole layer may be 0.7 mm to 0.9 mm, preferably 0.8 mm thick; the fourth sole layer may be 1.1 mm to 1.3 mm, preferably 1.2 mm thick; the fifth sole layer may be 1.8 mm to 2.2 mm, preferably 2.0 mm thick; the sixth sole layer may be 1.1 mm to 1.3 mm, preferably 1.2 mm thick; and the seventh sole layer may be 1.8 mm to 2.2 mm, preferably 2.0 mm thick.

The toe cap may further comprise an innermost first toe cap layer of Kevlar®; a second toe cap layer of polyamide tricot engaging the first toe cap layer; a third toe cap layer of steel engaging the second toe cap layer; and fourth, fifth, sixth, and seventh layers of rubber, each engaging the previous toe cap layer.

The fourth toe cap layer may be 1.1 mm to 1.3 mm, preferably 1.2 mm thick; the fifth toe cap layer may be 0.13 mm to 0.17 mm, preferably 0.15 mm thick; and the sixth toe cap layer may be 1.8 mm to 2.2 mm, preferably 2.0 mm thick.

The back reinforcement may further comprise an innermost first back reinforcement layer of Kevlar®; and second through eighth layers of rubber, each engaging the previous back reinforcement layer.

The second back reinforcement layer may be 0.13 mm to 0.17 mm, preferably 0.15 mm thick; the third back reinforcement layer may be 1.8 mm to 2.2 mm, preferably 2.0 mm thick; the fourth back reinforcement layer may be 1.1 mm to 1.3 mm, preferably 1.2 mm thick; the fifth back reinforcement layer may be 0.90 mm to 1.1 mm, preferably 1.0 mm thick; the sixth back reinforcement layer may be 1.3 mm to 1.7 mm, preferably 1.5 mm thick; the seventh back reinforcement layer may be 1.1 mm to 1.3 mm, preferably 1.2 mm thick; and the eighth back reinforcement layer may be 4.0 mm to 5.0 mm, preferably 4.5 mm thick.

The protective boot may also have at least one layer of Nomex® (TM of E.I. du Pont de Nemours); in each of the upper, the foxing and the sole. Each layer of the vamp, the rear leg and the sole may be bonded to each adjacent layer by a high-temperature adhesive. The protective boot may be a slip on boot.

BRIEF DESCRIPTION OF THE SEVERAL VIEWS OF THE DRAWINGS

A detailed description of the preferred embodiments is provided below by way of example only and with reference to the following drawings, in which.

Figure 1:
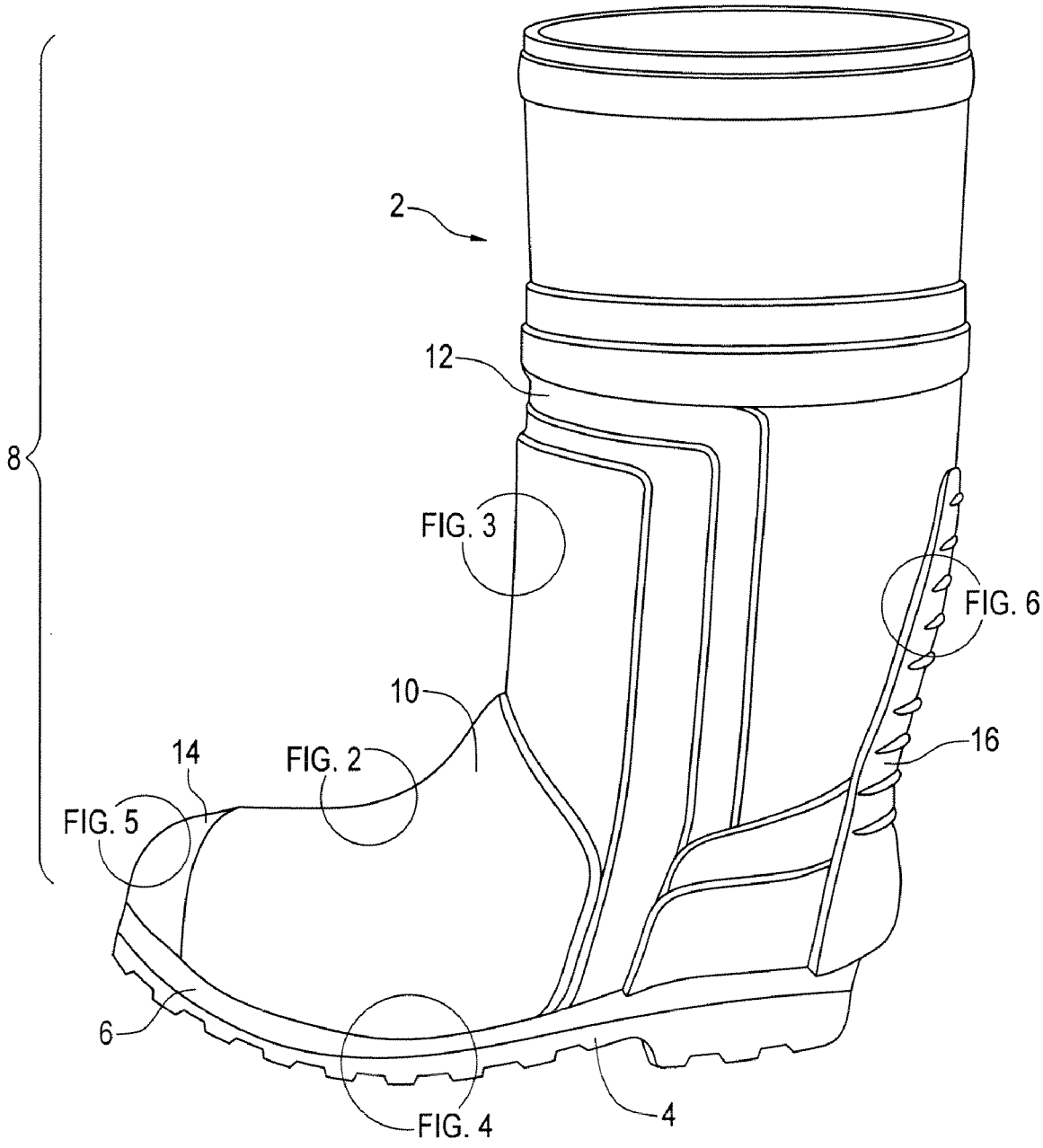
FIG. 1 is a perspective view of a boot, according to one embodiment of the present invention.

In the drawings, one embodiment of the invention is illustrated by way of example. It is to be expressly understood that the description and drawings are only for the purpose of illustration and as an aid to understanding, and are not intended as a definition of the limits of the invention.

DETAILED DESCRIPTION OF THE INVENTION

In the following detailed description of the invention, reference numerals are used to identify structural elements, portions of elements, or surfaces in the drawings, as such elements, portions or surfaces may be further described or explained by the entire written specification. For consistency, whenever the same numeral is used in different drawings, it indicates the same element, portion, surface and area as when first used. It should be understood that only those components having particular functional importance or that would not otherwise be identified have been assigned reference numerals.

The present invention describes a protective boot which meets the required standards for firefighter protective boots, as set out in NFPA 1971:2007, CE/EN ISO 20345-2:1996, and CSA-Ω, which require that firefighter protective boots provide flame resistance, electric shock resistance, metatarsal region protection, and sole puncture protection.

Further, the protective boot of the present invention meets the required standards for chainsaw operator protective boots, namely, CE/EN ISO 20345-2 SB E, CSA Class 1/ANSI, CE Chainsaw Class 3, and CSA "Green Tree" Chainsaw Z195-02. These standards require that the boots be constructed to prevent a chainsaw running at 28 meters per second, with pressure of 30 Newtons, run until the chainsaw stops, from fully penetrating the boot through the vamp and leg area. This is achieved through the use of layers of a rubber blend and polyamide tricot in the vamp.

As illustrated in FIG. 1, a protective boot 2, constituting a preferred embodiment of this invention, comprises a sole 4, a foxing 6, and an upper 8. The upper includes a vamp 10, a leg 12, a toe cap 14 and a back reinforcement 16.

Figure 2:
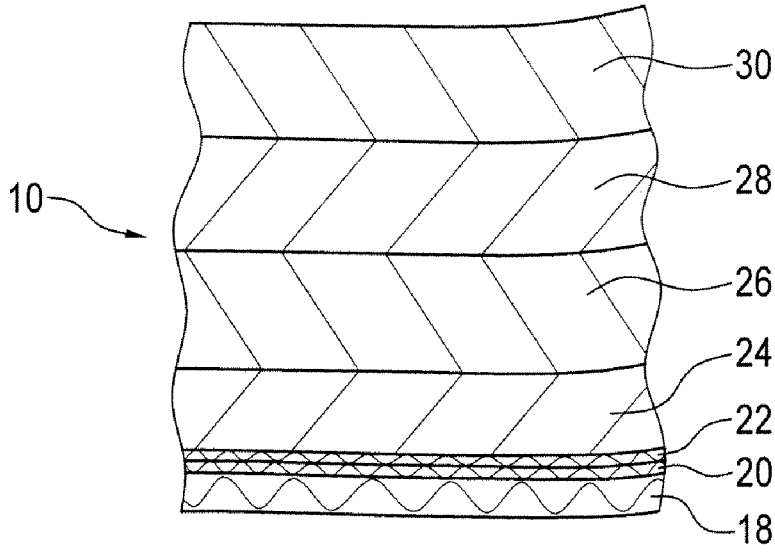
FIG. 2 is a cross-sectional view of the vamp of the boot shown in FIG. 1.

As shown in FIG. 2, the vamp 10 may further comprise a plurality of layers. In a preferred embodiment, the vamp may comprise, an innermost first vamp layer 18 containing Kevlar®; a second vamp layer 20 containing polyamide tricot engaging the first vamp layer; a third vamp layer 22 of polyamide tricot engaging the second vamp layer; a fourth vamp layer 24 of rubber engaging the third vamp layer; a fifth vamp layer 26 of rubber engaging the fourth vamp layer; a sixth vamp layer 28 of rubber engaging the fifth vamp layer; and an outermost seventh vamp layer 30 of rubber engaging the sixth vamp layer.

In the preferred embodiment, the innermost first vamp layer 18 preferably is 0.60 mm thick; the polyamide tricot in the second vamp layer 20 preferably is 0.20 mm thick; the third vamp layer 22 preferably is 0.20 mm thick; the fourth vamp layer 24 preferably is 1.2 mm thick; and the fifth vamp layer 26 preferably is 2.0 mm thick.

Figure 3:
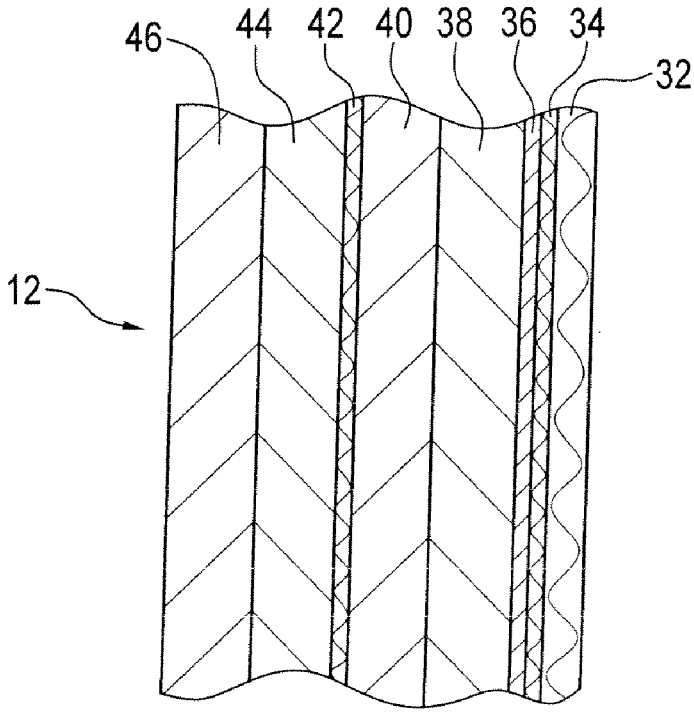
FIG. 3 is a cross-sectional view of the leg of the boot shown in FIG. 1.

As shown in FIG. 3, the leg 12 may further comprise a plurality of layers. In a preferred embodiment, the leg may comprise an innermost first leg layer 32 containing Kevlar®; a second leg layer 34 of polyamide tricot engaging the first leg layer; a third leg layer 36 of rubber and polyester textile engaging the second leg layer; a fourth leg layer 38 of rubber engaging the third leg layer; a fifth leg layer 40 of rubber engaging the fourth leg layer; a sixth leg layer 42 of polyamide tricot engaging the fifth leg layer; a seventh leg layer 44 of rubber engaging the sixth leg layer; and an outermost eighth leg layer 46 of rubber engaging the seventh leg layer.

In the preferred embodiment, the innermost first leg layer 32 preferably is 0.63 mm thick; the polyamide tricot in the second leg layer 34 preferably is 0.20 mm thick; the third leg layer 36 preferably is 0.15 mm thick; the fourth leg layer 38 preferably is 1.2 mm thick; the fifth leg layer 40 preferably is 1.0 mm thick; the seventh leg layer 44 preferably is 1.0 mm thick; and the outermost eighth leg layer preferably is 1.2 mm thick.

Figure 4:
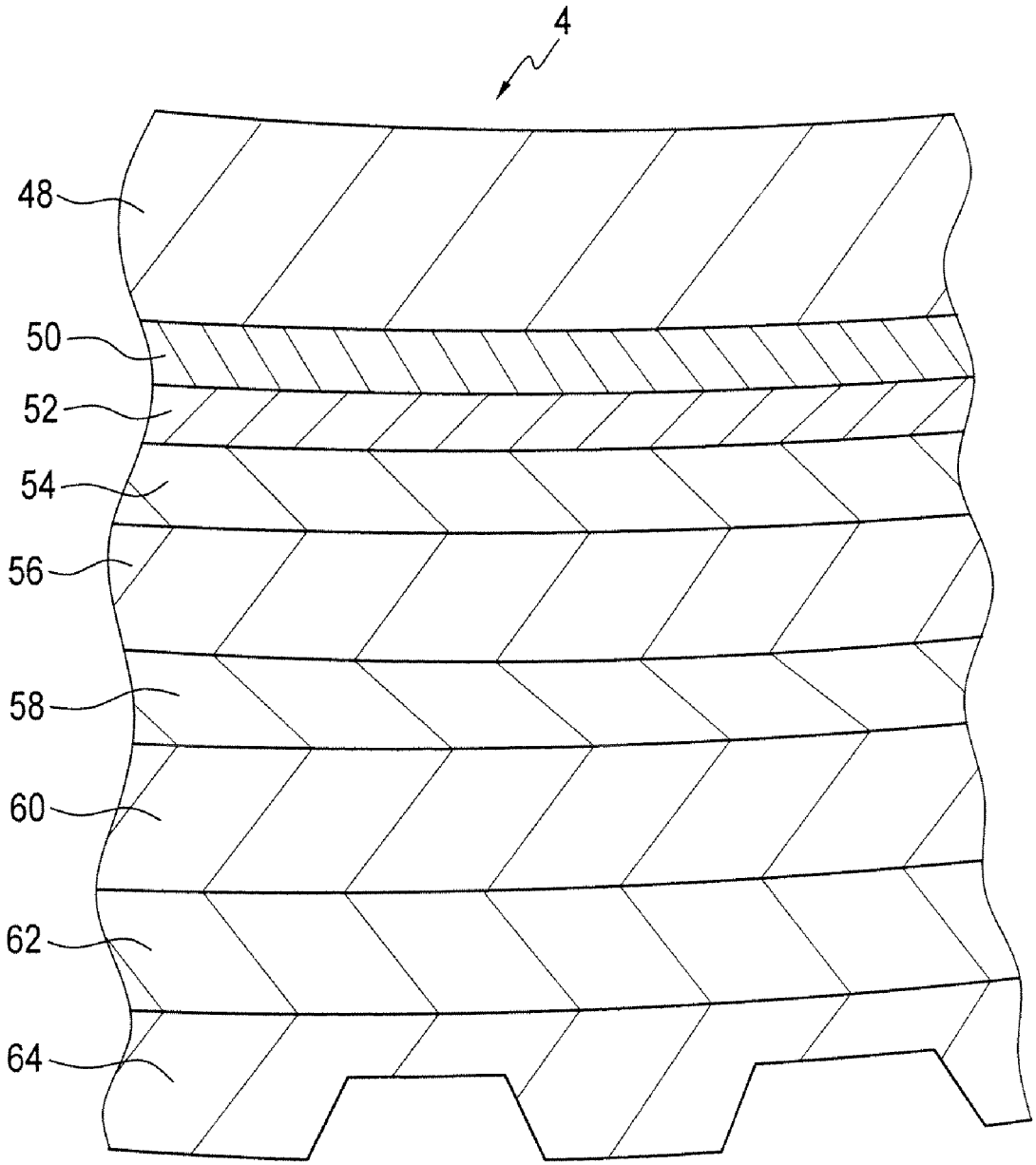
FIG. 4 is a cross-sectional view of the sole of the boot shown in FIG. 1.

As shown in FIG. 4, the sole 4 may further comprise a plurality of layers. In a preferred embodiment, the sole may comprise an innermost first sole layer 48 containing rubber; a second sole layer 50 of rubber and steel engaging the first sole layer; a third sole layer 52 of rubber engaging the second sole layer; a fourth sole layer 54 of rubber, engaging the third sole layer; and fifth 56, sixth 58, seventh 60, eighth 62, and ninth 64 layers of rubber, each engaging the previous sole layer.

In the preferred embodiment, the innermost first sole layer 48 preferably is 3.0 mm thick; the steel in the second sole layer 50 preferably is 1.0 mm thick; the third sole layer 52 preferably is 0.8 mm thick; the fourth sole layer 54 preferably is 1.2 mm thick; the fifth sole layer 56 preferably is 2.0 mm thick; the sixth sole layer 58 preferably is 1.2 mm thick; and the seventh sole layer 60 preferably is 2.0 mm thick.

Figure 5:
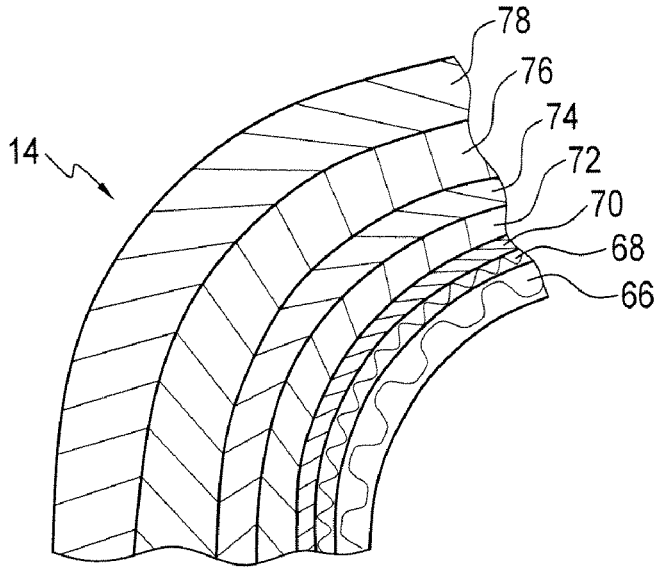
FIG. 5 is a cross-sectional view of the toe cap of the boot shown in FIG. 1.

As shown in FIG. 5, the toe cap 14 may further comprise a plurality of layers. In a preferred embodiment, the toe cap may comprise an innermost first toe cap layer 66 of Kevlar®; a second toe cap layer 68 of polyamide tricot engaging the first toe cap layer; a third toe cap layer 70 of steel engaging the second toe cap layer; and fourth 72, fifth 74, sixth 76, and seventh 78 layers of rubber, each engaging the previous toe cap layer.

In the preferred embodiment, the fourth toe cap layer 72 preferably is 1.2 mm thick; the fifth toe cap layer 74 preferably is 0.15 mm thick; and the sixth toe cap layer 76 preferably is 2.0 mm thick.

Figure 6:
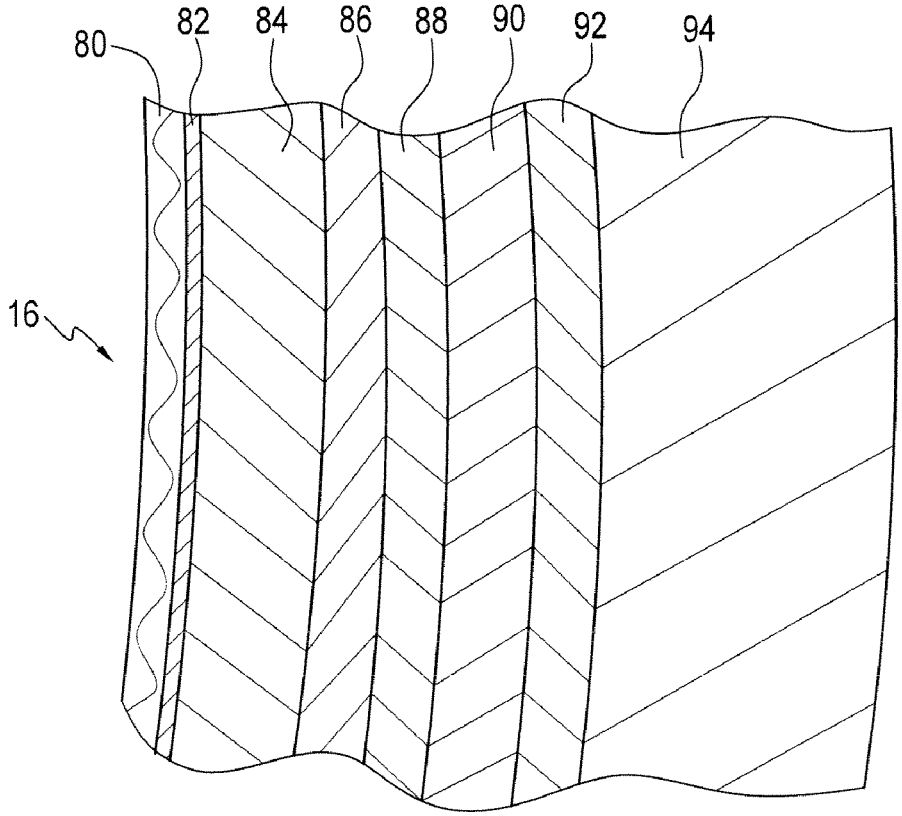
FIG. 6 is a cross-sectional view of the back reinforcement of the boot shown in FIG. 1.

As shown in FIG. 6, the back reinforcement 16 may further comprise a plurality of layers. In a preferred embodiment, the back reinforcement may comprise an innermost first back reinforcement layer 80 of Kevlar®; and second through eighth layers (82, 84, 86, 88, 90, 92, 94) of rubber, each engaging the previous back reinforcement layer.

In the preferred embodiment, the second back reinforcement layer 82 preferably is 0.15 mm thick; the third back reinforcement layer 84 preferably is 2.0 mm thick; the fourth back reinforcement layer 86 preferably is 1.2 mm thick; the fifth back reinforcement layer 88 preferably is 1.0 mm thick; the sixth back reinforcement layer 90 preferably is 1.5 mm thick; the seventh back reinforcement layer 92 preferably is 1.2 mm thick; and the eighth back reinforcement layer 94 preferably is 4.5 mm thick.

The thickness of each layer is selected to provide the optimum balance of protection, comfort and cost. Variation in the thickness of each of the layers in the vamp, the leg, the rear reinforcement, the sole and the toe cap is permissible within approximately 10% of the thickness of each layer, as set out above.

The various layers in the protective boot are bonded together through vulcanization, a high temperature treatment process. The arrangement of the layers forming the vamp may be modified, provided the polyamide tricot remains as a middle layer in the vamp, the leg and the toe cap.

The rubber material use in the upper of the protective boot is a blend of approximately 60% natural rubber, 20% nitrile rubber and 20% neoprene rubber selected to optimize flame resistance, abrasion resistance, chemical resistance, thermal protection and other characteristics of natural or synthetic rubbers. In the sole and the foxing of the protective boot, a higher percentage of nitrile or neoprene is incorporated to improve abrasion resistance and resistance to oil and fat degradation, to which the sole and foxing are subject to a higher degree through ground contact.

As well as resisting cutting, the rubber used in each part of the boot is selected to optimize electric shock resistance. While natural rubber is an insulator, electrical shock resistance can be improved using rubber blends containing synthetic rubbers to create a denser rubber material more resistant to electric shock.

Polyamide tricot is added to improve cutting resistance in the protective boots. The presence of polyamide tricot adds tensile strength to the rubber blend in the vamp and leg, which enhances the materials ability to withstand tearing. In addition, when polyamide is cut into by a chainsaw blade, the polyamide tricot fibres act as a binding agent to bind the chain and stop its rotation.

Kevlar® is an engineered elastomer material used in the rubber industry. Its presence in the protective boot enhances the boots cut resistance and tear resistance.

It is to be understood that the rubber, Kevlar®, and polyamide tricot materials described for the preferred embodiment may be substituted by other materials which, collectively, would provide a combination of flame resistance, electric shock resistance and the ability to withstand contact by an operating chainsaw blade which meets the NFPA 1971:2007, CE/EN ISO 20345-2:1996, and CSA-Ω standards for firefighter protective footwear and the CE/EN ISO 20345-2 SB E, CSA Class 1/ANSI, CE Chainsaw Class 3, and CSA "Green Tree" Chainsaw Z195-02 standards for chainsaw operator protective footwear.

The protective boot preferably further includes at least one layer of Nomex® in each of the upper and the sole. Nomex® is a flame resistant and insulating material optionally used inside the protective boot. It provides heat and flame protection should the outer boot begin to flame, and it also provides thermal protection to the wearer.

Preferably, the protective boot is of a style which may be slipped on without need of laces, buckles or other fastening devices, although the invention is to be understood to include other styles of boots as well.

It will be appreciated by those skilled in the art that other variations of the preferred embodiment may also be practised without departing from the scope of the invention.

What is claimed is:

1. A protective boot comprising:

an upper having a multilayer leg, a multilayer vamp, a multilayer toe cap and a multilayer back reinforcement;

a foxing; and a multilayer sole; wherein the protective boot has at least one layer in the upper, the sole and the foxing of a flame-resistant rubber blend containing natural rubber, neoprene rubber and nitrile rubber;

at least one layer in each of the upper, the foxing and the sole of an electric shock resistant rubber blend containing a synthetic rubber which has an electrical resistance sufficient to insulate to a minimum of 18 Kilovolts; and at least one layer in each of the vamp and the leg of a para-aramid synthetic fibre at least one internal layer in each of the vamp and leg of polyamide tricot, and at least one layer in each of the vamp and the leg of a rubber blend containing natural rubber, neoprene rubber and nitrile rubber;

wherein the vamp further comprises:

an innermost first vamp layer containing a para-aramid synthetic fibre;

a second vamp layer containing polyamide tricot engaging the first vamp layer;

a third vamp layer of polyamide tricot engaging the second vamp layer;

a fourth vamp layer of rubber engaging the third vamp layer;

a fifth vamp layer of rubber engaging the fourth vamp layer;

a sixth vamp layer of rubber engaging the fifth vamp layer; and a outermost seventh vamp layer of rubber engaging the sixth vamp layer;

and wherein the leg further comprises:

an innermost first leg layer containing a para-aramid synthetic fibre;

a second leg layer of polyamide tricot engaging the first leg layer;

a third leg layer of rubber and polyester textile engaging the second leg layer;

a fourth leg layer of rubber engaging the third leg layer;

a fifth leg layer of rubber engaging the fourth leg layer;

a sixth leg layer of polyamide tricot engaging the fifth leg layer;

a seventh leg layer of rubber engaging the sixth leg layer; and an outermost eighth leg layer of rubber engaging the seventh leg layer; and wherein the sole further comprises:

an innermost first sole layer containing rubber;

a second sole layer of rubber and steel engaging the first sole layer, wherein the second sole layer is positioned below the entire expanse of the vamp;

a third sole layer of rubber engaging the second sole layer;

a fourth sole layer of rubber, engaging the third sole layer; and fifth, sixth, seventh, eighth, and ninth layers of rubber, each engaging the previous sole layer.

2. The protective boot of claim 1, wherein:

the sole further comprises:

(i) an innermost first sole layer containing rubber;

(ii) a second sole layer of rubber and steel engaging the first sole layer, wherein the second sole layer is positioned below the entire expanse of the vamp;

(iii) a third sole layer of rubber engaging the second sole layer;

(iv) a fourth sole layer of rubber, engaging the third sole layer; and (v) fifth, sixth, seventh, eighth, and ninth layers of rubber, each engaging the previous sole layer;

the toe cap further comprises:

(i) an innermost first toe cap layer of a para-aramid synthetic fibre;

(ii) a second toe cap layer of polyamide tricot engaging the first toe cap layer;

(iii) a third toe cap layer of steel engaging the second toe cap layer; and (iv) fourth, fifth, sixth, and seventh layers of rubber, each engaging the previous toe cap layer; and the back reinforcement further comprises:

(i) an innermost first back reinforcement layer of a para-aramid synthetic fibre; and (ii) second through eighth layers of rubber, each engaging the previous back reinforcement layer.

* * * * *